United States Patent [19]

Kameda

[11] Patent Number: 4,583,346

[45] Date of Patent: Apr. 22, 1986

[54] METHOD AND APPARATUS FOR PRESSURIZING CONTAINERS

[75] Inventor: Toshinori Kameda, Ishioka, Japan

[73] Assignee: National Can Corporation, Chicago, Ill.

[21] Appl. No.: 515,334

[22] Filed: Jul. 19, 1983

[51] Int. Cl.[4] ..... B65B 55/00

[52] U.S. Cl. ..... 53/431; 53/111 R; 141/6; 141/51; 141/67

[58] Field of Search ..... 53/431, 432, 111, 510; 426/392, 397; 141/6, 51, 45, 115, 67; 222/318

[56] References Cited

U.S. PATENT DOCUMENTS

| | | | |
|---|---|---|---|
| 2,387,894 | 10/1945 | Fannin | 141/45 |
| 2,643,807 | 6/1953 | Gialanella | 141/45 |
| 3,877,358 | 4/1975 | Karr | 141/6 |
| 3,881,636 | 5/1975 | D'Aubreby | 141/51 |
| 4,407,340 | 10/1983 | Jensen et al. | 141/67 |

FOREIGN PATENT DOCUMENTS

| | | | |
|---|---|---|---|
| 1455652 | 11/1976 | United Kingdom | 53/431 |
| 2089191 | 6/1982 | United Kingdom | 426/397 |

*Primary Examiner*—John Sipos
*Assistant Examiner*—Donald R. Studebaker
*Attorney, Agent, or Firm*—Robert A. Stenzel

[57] ABSTRACT

Pressurization of containers with liquid nitrogen to impart container strength and content protection is effected by injecting a small quantity of liquid nitrogen before sealing the container by the methods and apparatus including a gas pressure system wherein liquid nitrogen is maintained by control means at a constant pressure with nitrogen gas being separated from liquid nitrogen before dispensing and a recirculating pump pressure system wherein liquid nitrogen from a second of two supplies is pumped through a conduit to a dispensing gun and surplus liquid and gas is returned to the supply.

4 Claims, 2 Drawing Figures

METHOD AND APPARATUS FOR PRESSURIZING CONTAINERS

BACKGROUND OF THE INVENTION

This invention relates to a method for pressurizing containers by means of dispensing liquefied nitrogen into metal cans made of relatively thin aluminum or steel material, sealing the cans and then causing the liquefied nitrogen to gassify in the cans so as to preserve the contents of the cans and to create pressure therein to impart to them sufficient strength. The invention is suitable for preparing cans filled with liquid beverages or drinks not containing carbon dioxide.

A drawing and ironing method is now being widely used to manufacture what are referred to as two-piece cans made of steel or aluminum sheets having a wall thickness of about 0.15 mm. These two-piece cans as they are called are used for containing beverages because they are strong, efficient, lightweight and can be quickly heated or cooled. Aluminum cans also have the advantage that most liquids contained therein will not deteriorate or degrade in taste even though the inner surface of the cans is not subjected to any special treatment. In addition, since aluminum has an excellent workability, it is possible to integrally form its body or cylindrical portion and bottom portion, thereby reducing the manufacturing cost.

When the thin walled aluminum or steel cans are charged with such liquid beverages as beer or beverage containing carbon dioxide, the carbon dioxide liberated creates an internal pressure sufficient to increase the mechanical strength of the cans. However, when the cans are filled with liquid beverages not containing carbon dioxide, for example, coffee, fruit juice, plain water and wine, the internal pressure is not created. Accordingly, for use in such liquid beverages not containing carbon dioxide, one alternative has been to increase the wall thickness for the purpose of increasing the mechanical strength of the cans, and thin sheets manufactured by the drawing and ironing method cannot be used.

The general concept of adding liquid nitrogen to thin-walled containers has been broadly disclosed in U.K. Pat. No. 1,455,652; however, in that instance, the details of the apparatus are very sketchy. German OLS No. 3,141,465 published July 15, 1982, includes additional apparatus; however, this is concerned with specific details unrelated to the method herein. Japanese published applications Nos. 56-4521, 49-4389 and 145686/76, U.S. Pat. No. 2,978,336 and Canadian Pat. No. 1,062,671 also disclose use of liquid nitrogen in packaging but are not considered relevant to the present invention.

SUMMARY OF THE INVENTION

It is therefore an object of this invention to provide a method for injecting into and sealing liquefied nitrogen in containers having a thin wall thickness, for example less than 0.2 mm, and partially filled with various types of liquid beverages or plain water so as to create an internal pressure which increases the mechanical strength of the thin-walled containers.

According to one aspect of the invention there is provided a method for sealing nitrogen in a metal can wherein a liquefied nitrogen is injected into a metal can by means of a gun, the operation of the gun being controlled by a sensor detecting the metal can at a predetermined position and by an injection time regulator, and wherein the pressure of the liquefied nitrogen supplied to the gun is made constant, whereby the liquefied nitrogen is sealed off in the metal can while partially remaining in a liquid state.

The method is additionally characterized in that the liquefied nitrogen is prepared in a container with a top portion thereof being filled with a gassified nitrogen, a pressure detector is connected to the top portion of said container for detecting the pressure of the gassified nitrogen contained therein, a signal produced by said pressure detector is supplied to a pressure control mechanism which makes constant the pressure of the liquefied nitrogen contained in said container by means of shut-off arrangements connected thereto, the liquefied nitrogen of a constant pressure is supplied to said gun through a conduit, and the operation of said gun is controlled by a sensor detecting said metal can being in a predetermined position and by an injection time regulator, whereby the liquefied nitrogen is sealed off in said metal can while partially remaining in a liquid state.

A further feature of the method is that the liquefied nitrogen is supplied from a liquefied nitrogen cylinder to said gun through an intermediate tank, the operation of said gun is controlled by a sensor detecting said container being in a predetermined position and by an injection time regulator, a pressure of the liquefied nitrogen supplied to said gun is made constant, and the surplus liquefied nitrogen is returned back to said intermediate tank from said gun.

The conduit supplying the liquefied nitrogen of a constant pressure to said gun is provided with a gas/liquid separator so that only the liquefied nitrogen is supplied to said gun. According to another aspect of the invention, the liquid beverage not containing carbon dioxide contained in the metal cans is preheated to a temperature of 60°–95° C. for sterilization.

BRIEF DESCRIPTION OF THE DRAWINGS

In the accompanying drawings.

DESCRIPTION OF THE PREFERRED EMBODIMENTS

Figure 1:
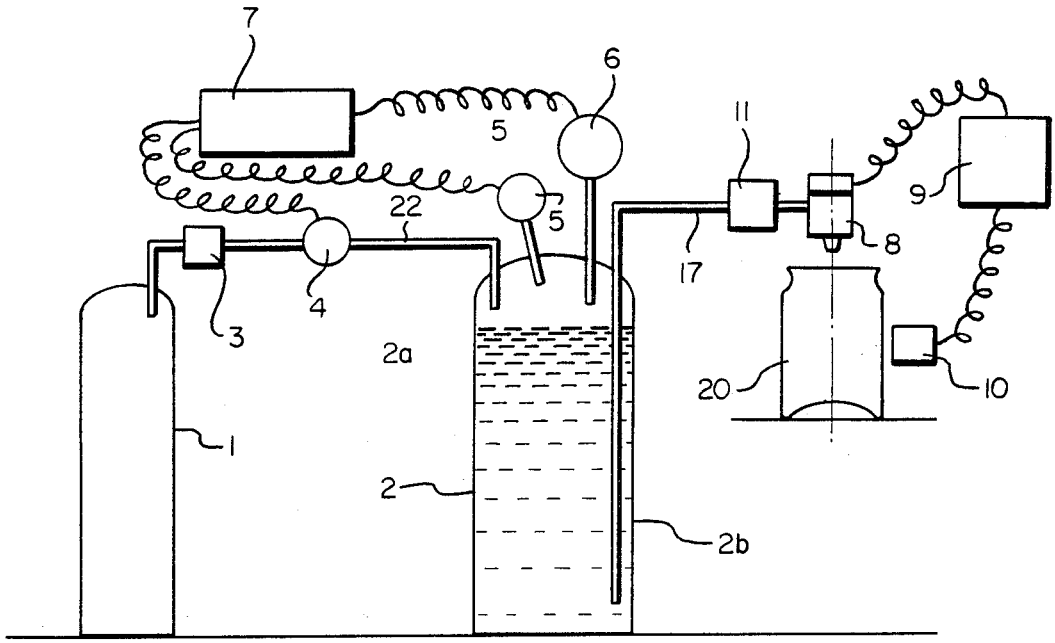
FIG. 1 is a diagrammatic representation of apparatus utilized to carry out the invention.

In the embodiment shown in FIG. 1, a nitrogen gas cylinder 1 and a liquefied nitrogen cylinder 2 are provided. The nitrogen gas cylinder 1 is communicated with the liquefied nitrogen cylinder 2 through a conduit 22 including a pressure regulator 3 and a motor operated valve 4. At the top portion 2*a* of the cylinder 2 containing nitrogen gas are provided a motor operated gas release valve 5 and a pressure detector 6. A pressure level signal produced by the pressure detector 6 is supplied to a pressure control unit 7, which may take the form of a computer or a back pressure regulator, and the output signal of the pressure control unit 7 is applied to the motor operated valves 4 and 5 to actuate them to either respectively increase or decrease pressure so as to maintain the pressure of the liquefied nitrogen in cylinder 2 at a substantially constant pressure.

A conduit 17 extending into the body 2*b* of the cylinder 2 is in communication with a motor operated gun or injector 8 through a gas/liquid separator 11. The gun 8 injects liquified nitrogen into a metal can 20 successively brought to a position beneath the gun 8. Adjacent the can 20 is disposed a can sensor 10, and the output signal thereof is supplied to the motor operated gun 8 through a timer 9 for ejecting the liquefied nitrogen into the can 20 for a predetermined interval of time. The method of controlling the feed speed of cans and the method of sealing cans are well known in the art. Usually, the cans are continuously fed at a speed of from 600 to 1800 cans per minute and on average, at a speed of 1200 cans per minute. After injection of the liquified nitrogen the opening at the top of the can is immediately sealed off.

Figure 2:
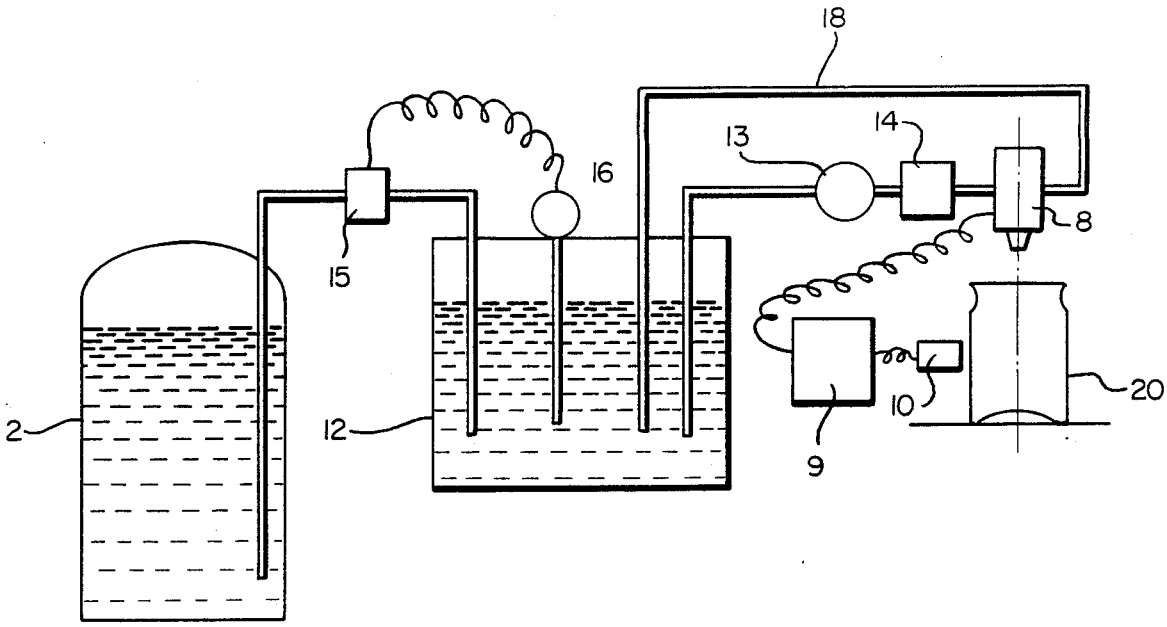
FIG. 2 is a diagrammatic representation showing a modification of the apparatus shown in FIG. 1.

In the modification shown in FIG. 2, the nitrogen gas cylinder 1 is omitted and an intermediate liquefied nitrogen tank 12 is connected to the liquefied nitrogen cylinder 2 via a motor operated valve 15 which is controlled by a liquid level controller 16 to maintain the level of the liquefied nitrogen in the intermediate tank 12 at a constant level. The liquefied nitrogen in the intermediate tank 12 is sent to the motor operated gun 8 via a pump 13 and a pressure regulator 14. Nitrogen gas generated while the liquefied nitrogen is conveyed to the gun 8 and surplus liquefied nitrogen are returned to the intermediate tank 12 via conduit 18.

A pressurized air operated gun may be substituted for the motor operated gun. However, since liquefied nitrogen should be maintained at an extremely low temperature a motor operated gun is preferred in view of temperature difference and response speed.

Following examples are given for explaining the embodiments of the method of this invention where apparatus shown in FIGS. 1 and 2 are used.

EXAMPLE 1

This example uses the apparatus shown in FIG. 1. As is well known in the art, nitrogen is maintained in a liquid state when the temperature is below −196° C., and when the temperature rises above this temperature the liquefied nitrogen gassifies so that cylinders 1 and 2 and conduit 22 interconnecting them and the conduit 17 interconnecting the cylinder 2 and the gun 8 are coated with suitable heat insulating material. Under these conditions, liquefied nitrogen was injected into aluminum cans 20 each having a capacity of 267 cc and a wall thickness of 0.1 mm and manufactured by the drawn and iron method. Each can was filled beforehand with 256–258 cc of warm water preheated to 85° C. After injecting the liquefied nitrogen the opening at the top of the can is sealed off so that the liquefied nitrogen is filled in the can with a space therein of about 15–17 cc. The cans 20 were fed at a speed of 1200 cans per minute. The time of opening the gun 8 controlled by the can sensor 10 was set to 0.015 sec., and the gauge pressure at the top portion 2*a* in the cylinder 2 as 0.5 kg/cm$^2$. Under these conditions, 0.2 cc of liquefied nitrogen was injected into each can 20 at a speed of 1200 cans/min. The opening into which the liquid nitrogen was injected was sealed off by applying a lid thereto in a time of about 1 second after injection of the liquefied nitrogen. Sealing was effected by double seaming the lid on. After sealing, the liquefied nitrogen gassified at a room temperature of 20° C. to increase the pressure in the sealed can to a gauge pressure of 0.8–1.2 kg/cm$^2$ which is sufficient to increase the mechanical strength of the can.

EXAMPLE 2

In this example, the apparatus shown in FIG. 2 was used and the same aluminum can as used in Example 1 was used. The quantity of the liquefied nitrogen sent to the pump 13 was 5000 cc/min. The injection gun 8 had an inner diameter of 2.4 mm and the liquefied nitrogen was supplied at a pressure of 0.3 kg/cm$^2$ by the action of the pressure regulator 14. Surplus liquefied nitrogen was returned to the intermediate tank 12 via conduit 18. Each can 20 made of an aluminum sheet having a thickness of 0.1 mm had a capacity of 267 ml and was prefilled with 256 –258 ml of warm water preheated to about 85° C. Immediately thereafter, 0.25 cc of the liquefied nitrogen was injected into each can, and less than two seconds later a lid was applied to the can which sealed the same. After sealing, the internal pressure of the can was found to be at a gauge pressure of 0.8–1.2 kg/cm$^2$ at a temperature of 20° C.

The results of Examples 1 and 2 show that the method of this invention are suitable for producing cans containing coffee, fruit juice, various drinks, etc.

As above described, according to this invention, it is possible to manufacture strong cans filled with liquid beverages not containing carbon dioxide, and to inject liquefied nitrogen at high efficiencies.

Although the teachings of the invention have been discussed with reference to certain specific disclosured embodiments, it is to be understood that these are by way of illustration only and that variations may be made in the methods and apparatus without departing from the spirit and scope of the invention, as defined by the appended claims.

I claim:

1. An apparatus for preparing a canned product not containing carbon dioxide, comprising in combination, a liquid nitrogen reservoir (2); an injection nozzle (8) adapted to inject liquid nitrogen into a cam (20) which contains a product not containing any effective amount of carbon dioxide; a conduit (17) for conveying liquid nitrogen from said liquid nitrogen reservoir to said injection nozzle; means (6) for detecting pressure in a head space in said liquid nitrogen reservoir, said pressure being determinant to injection rate of liquid nitrogen into said can; means for controlling said pressure within a small predetermined range in response to an electical signal from said detecting means such that a substantially constant pressure is maintained in the head space of said reservoir, and including a pressurized nitrogen source connected through a first valve means to said reservoir; with a second valve means connected to said head space to be able to vent said head space and a pressure control unit for selectively operating said first valve means to increase the pressure in said headspace and for selectively operating said second valve means to decrease the pressure in said headspace in response to said detecting means to maintain a substantially constant predetermined injection rate; a sensor (10) for detecting the presence of said can and generating a signal when said can is present; a timer (9) operated in response to said signal from said sensor to control duration of injection of liquid nitrogen into said can.

2. A method for preparing a canned product not containing carbon dioxide, comprising the step of placing a pressurized nitrogen source in communication with a reservoir with a first valve therebetween, monitoring the pressure of the head space in said reservoir and generating a signal as a function thereof, supplying said signal to a pressure control mechanism connected to said first valve and a second valve in communication with said head space, operating said valves through said control mechanism for increasing said pressure in said head space by supplying additional pressurized nitrogen to said reservoir through said first valve and decreasing the pressured in said head space by venting said head space through said second valve to maintain the head space pressure within a small predetermined range to maintain a substantially constant flow of pressurized liquid nitrogen, delivering pressurized liquid nitrogen from said reservoir through a conduit to an injection nozzle, detecting the presence of a can below said nozzle and operating said nozzle for a predetermined time to control the amount of liquid nitrogen introduced into the can, and immediately sealing the opening of the can.

3. An apparatus for injecting liquid nitrogen into a can containing a product not containing carbon dioxide, comprising in combination:

a liquid nitrogen containing tank, having a head space connected to a gaseous nitrogen source;

an injection nozzle adapted to inject said liquid nitrogen into a can which contains a product not containing carbon dioxide;

a supply line adapted to supply therethrough said liquid nitrogen from said liquid nitrogen containing tank to said injection nozzle utilizing a positive pressure in said head space in said liquid nitrogen containing tank;

means for detecting pressure in said head space in said liquid nitrogen containing tank, said pressure being determinant to injection rate of said liquid nitrogen into said can;

means for controlling said pressure in said head space within a small predetermined range in response to an electric signal from said detecting means such that a substantially constant pressure is maintained in the headspace of said reservoir, said control means comprising a first valve operative to supply gaseous nitrogen from said gaseous nitrogen source into said head space to thereby increase said pressure therein, a second valve operative to release gaseous nitrogen in said head space to thereby reduce said pressure therein, and a pressure control unit for selectively operating said first and second valves in response to said electric signal to maintain a substantially constant predetermined injection rate;

a gas/liquid separator provided in said supply line between said liquid nitrogen containing tank and said injection nozzle for separating gasified nitrogen from said supply line;

a sensor for detecting the presence of said can and generating an electric signal when said can is present; and, a timer operated in response to said signal from said sensor to control duration of injection of liquid nitrogen into said can.

4. An apparatus for injecting liquid nitrogen into a can containing a product not containing carbon dioxide, comprising in combination:

a liquid nitrogen containing tank, having a head space connected to a gaseous nitrogen source;

an injection nozzle adapted to inject said liquid nitrogen into a can which contain a product not containing carbon dioxide;

a supply line adapted to supply therethrough said liquid nitrogen from said liquid nitrogen containing tank to said injection nozzle utilizing a positive pressure in said head space in said liquid nitrogen containing tank;

means for detecting liquid nitrogen conveying pressure in said liquid nitrogen contained tank, said pressure being determinant to injection speed of said liquid nitrogen in said can;

means for controlling the pressure in said head space in said liquid nitrogen containing tank to thereby control said liquid nitrogen conveying pressure in said supply line within a small predetermined range is response to an electric signal from said detecting means such that a substantially constant pressure is maintained in the headspace of said reservoir, said control means comprising a first valve operative to supply gaseous nitrogen from said gaseous nitrogen source into said head space to thereby increase said pressure therein, a second valve operative to release gaseous nitrogen in said head space to thereby reduce said pressure therein, and a pressure control unit for selectively operating said first and second valves in response to said electric siganl to maintain a substantially constant predetermined injection rate;

a gas/liquid separator provided in said supply line between said liquid nitrogen containing tank and said injection nozzle for separating gasified nitrogen from said supply line;

a sensor for detecting the presence of said can and generating an electric signal when said can is present; and, a timer operated in response to said signal from said sensor to control duration of injection of liquid nitrogen into said can.

* * * * *